US008439200B1

(12) United States Patent
Sorrells et al.

(10) Patent No.: US 8,439,200 B1
(45) Date of Patent: May 14, 2013

(54) DINING TRAY AND METHOD

(76) Inventors: Randall A. Sorrells, Kernersville, NC (US); Newton R. Stell, IV, Kernersville, NC (US)

( * ) Notice: Subject to any disclaimer, the term of this patent is extended or adjusted under 35 U.S.C. 154(b) by 0 days.

(21) Appl. No.: 13/369,457

(22) Filed: Feb. 9, 2012

(51) Int. Cl.
*A47G 19/22* (2006.01)

(52) U.S. Cl.
USPC ..... 206/565; 206/559; 220/23.88

(58) Field of Classification Search ..... 220/23.89, 220/23.88, 23.87, 23.86, 23.83, 556, 737, 220/574, 630, 636; 248/128, 127; 211/78, 211/74, 126.1, 133.6, 10; *B65D 21/02; A47G 19/22, 19/02*
See application file for complete search history.

(56) References Cited

U.S. PATENT DOCUMENTS

| | | | | | |
|---|---|---|---|---|---|
| 2,530,736 | A * | 11/1950 | Sheldon | 220/574.2 |
| 2,602,310 | A * | 7/1952 | Hansen | 206/426 |
| 2,938,645 | A * | 5/1960 | McCowan | 220/4.21 |
| 3,148,636 | A | 9/1964 | Bloomquist et al. | 108/26 |
| 4,534,469 | A * | 8/1985 | Elsmo | 206/560 |
| 4,927,024 | A | 5/1990 | Lloyd | 206/562 |
| 5,060,820 | A * | 10/1991 | Boerner | 220/574 |
| 5,240,136 | A * | 8/1993 | Patterson et al. | 220/574 |
| 5,356,008 | A * | 10/1994 | Chung | 206/449 |
| 5,586,800 | A | 12/1996 | Triplett | 297/148 |
| 5,871,098 | A * | 2/1999 | Storck | 206/557 |
| 6,439,388 | B1 * | 8/2002 | Lerner | 206/562 |
| 7,475,937 | B2 | 1/2009 | McGrew et al. | 297/148 |
| 2010/0065520 | A1 * | 3/2010 | Hsieh | 211/70.6 |

* cited by examiner

*Primary Examiner* — Mickey Yu
*Assistant Examiner* — Robert J Hicks

(57) ABSTRACT

A dining tray for use in preventing accidents and possibly food spillage. The tray includes a central T-shaped member and a pair of opposing L-shaped side members which engage rotated lateral members affixed to food containers. The method of use includes the steps of placing the lateral members of the food containers onto the inside, upper bottom surface of the tray and then by rotating the food container the lateral members engage the T-shaped member and L-shaped members whereby the containers are then held securely in place. After eating the food containers can be rotated in an opposite direction to release the lateral members for removal and cleaning purposes. In an alternate embodiment of the invention a locking clamp engages the tray and secures it to a table top or other surface.

12 Claims, 5 Drawing Sheets

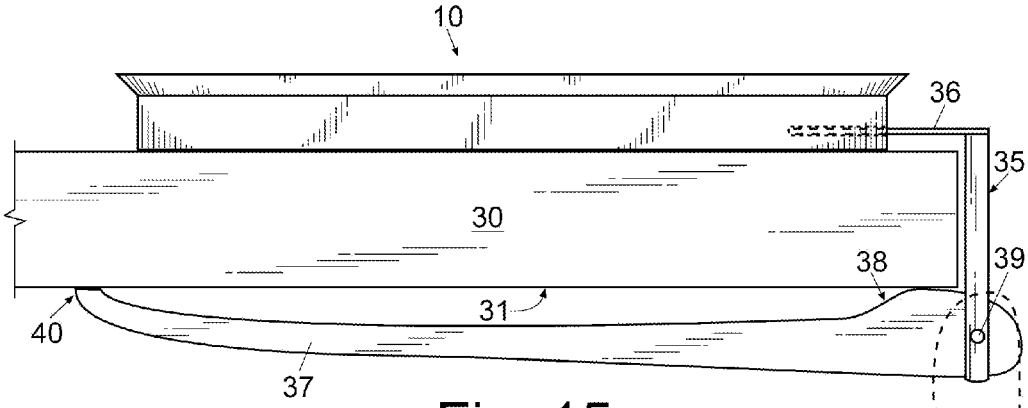
Fig. 15
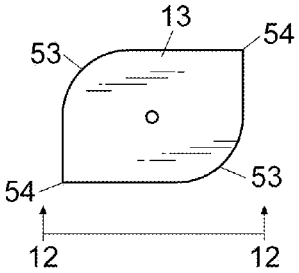
Fig. 10
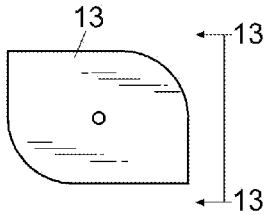
Fig. 11
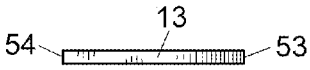
Fig. 12
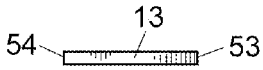
Fig. 13
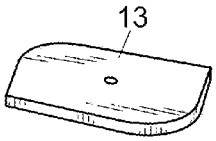
Fig. 14
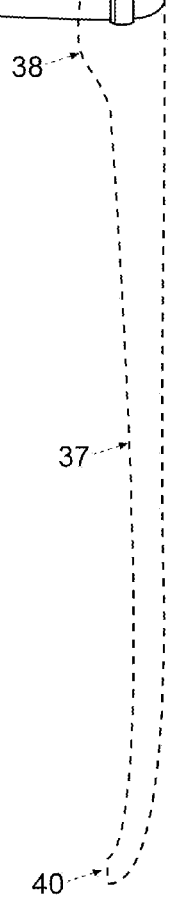

DINING TRAY AND METHOD

FIELD OF THE INVENTION

The invention herein pertains to dining trays and particularly pertains to a dining tray and method of use which will allow various shaped containers for food or beverages to be held on the dining tray during use. The food containers include a lateral member which when rotated engage the tray. The method of use provides for easily attaching and removing the containers from the tray as needed.

DESCRIPTION OF THE PRIOR ART AND OBJECTIVES OF THE INVENTION

In recent years the use of food/dining trays has become more popular in homes, vehicles, during travel and during other activities. Such trays allow for easy food consumption and for manual transportation to a seating area such as in a cafeteria, home or the like. While carrying by individuals open food containers can easily tilt and spill. Individuals with limited manual dexterity are usually more impacted.

Thus as a result of the problems and disadvantages associated with conventional dining trays and food containers, the present invention was conceived and one of its objectives is to provide a dining tray in which a variety of food containers can be easily releasably affixed.

It is another objective of the present invention to provide a dining tray for carrying a variety of food containers which are relatively inexpensive to make and sell.

It is still another objective of the present invention to provide a dining tray and food containers which each include a lateral member that is easily positioned within the tray and rotated to securely affix each of the containers in place on the tray.

It is yet another objective of the present invention to provide a dining tray having a opening therein for receiving a clamp to affix the tray to a table or other surface.

It is a further objective of the present invention to provide a dining tray having a pair of opposing L-shaped side members and a central T-shaped member which form a pair of channels in the tray.

It is still a further objective of the present invention to provide a base attached to the bottom of the food container and the lateral member of the food container.

It is still yet another objection of the present invention to provide a lateral member which is attached to the base which rotatably fits between the L-shaped side members and central T-shaped member to maintain the food container securely within the channel.

It is yet a further objective of the present invention to provide a method for using the dining tray and food/beverage containers.

Various other objectives and advantages of the present invention will become apparent to those skilled in the art as a more detailed description is set forth below.

SUMMARY OF THE INVENTION

The aforesaid and other objectives are realized by providing a dining tray having a central T-shaped member and a pair of opposing L-shaped side members. The central T-shaped member and L-shaped side members form two parallel tracks or channels in the tray for food/beverage container placement. The food containers each include a base and an S-shaped lateral member affixed to the bottom thereof. The lateral members are positioned within the slots of the tray whereby upon rotation of the containers, the lateral members will engage the defined slots formed by the opposing L-shaped side members and central T-shaped member. This engagement of the lateral members secures the containers in place and prevents the food/beverage containers from easily tilting or spilling. In another embodiment of the invention a mechanical clamp is provided for securing the dining tray to a table.

BRIEF DESCRIPTION OF THE DRAWINGS

FIG. 10 illustrates a top view of the lateral member as removed from the container;

FIG. 11 shows a bottom view of the lateral member as seen in FIG. 10;

FIG. 12 pictures a front elevational view of the lateral member as seen in FIG. 10 along lines 12-12, the opposing rear elevational view being a mirror image thereof;

FIG. 13 depicts a side elevational view of the lateral member as seen in FIG. 11 along lines 13-13, the opposing side elevational view being a mirror image thereof;

FIG. 14 demonstrates a perspective view of the lateral member; and

FIG. 15 schematically demonstrates the dining tray positioned on a table and clamped thereto;

DETAILED DESCRIPTION OF THE PREFERRED EMBODIMENT AND OPERATION OF THE INVENTION

Figure 1:
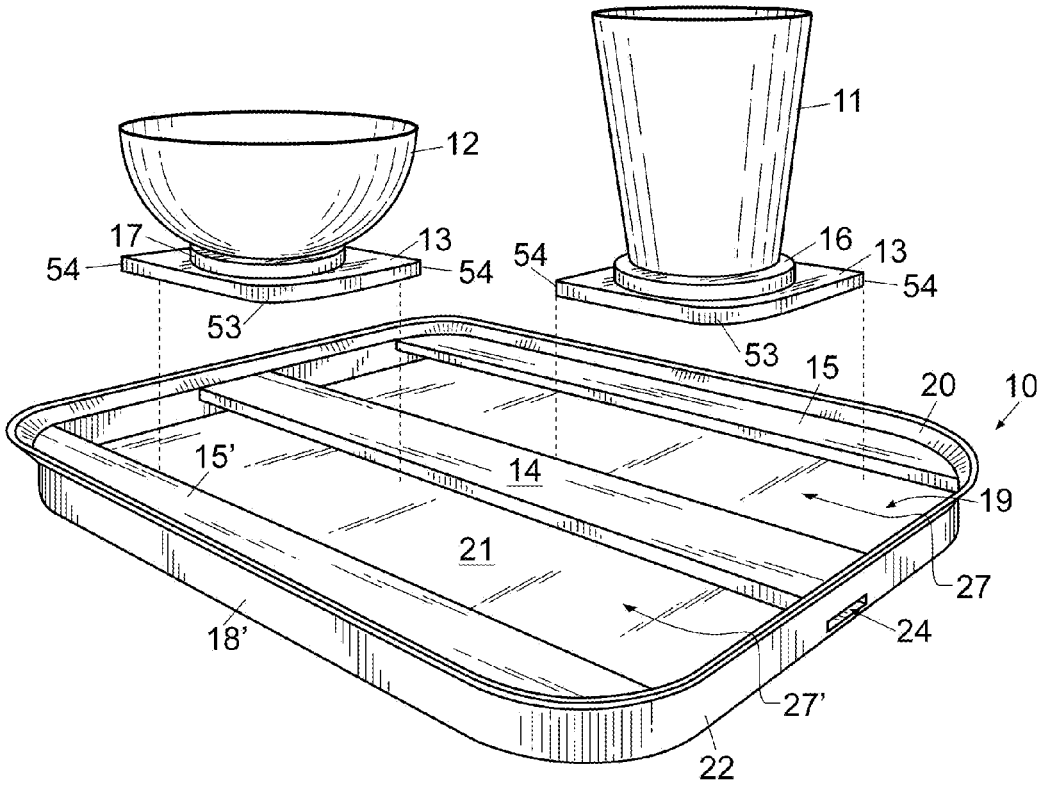
FIG. 1 shows a top, right, front perspective view of the dining tray with a food container and a beverage container exploded therefrom.
Figure 5:
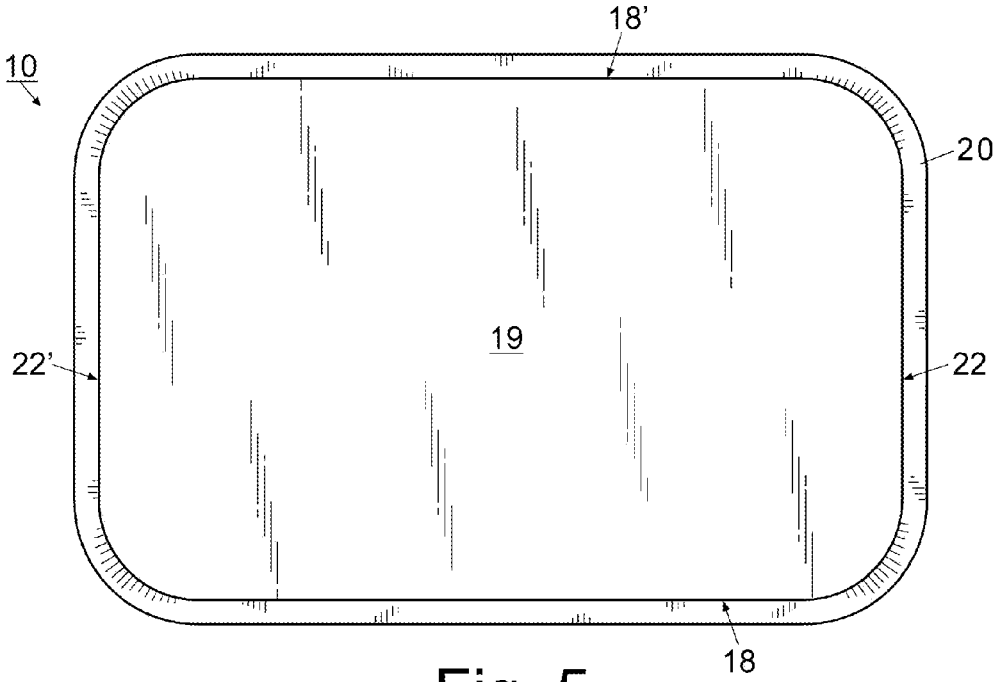
FIG. 5 illustrates a bottom view of the dining tray.
Figure 6:
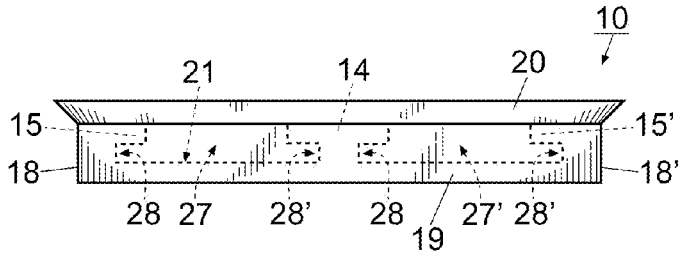
FIG. 6 shows a left end elevational view of the dining tray.
Figure 7:
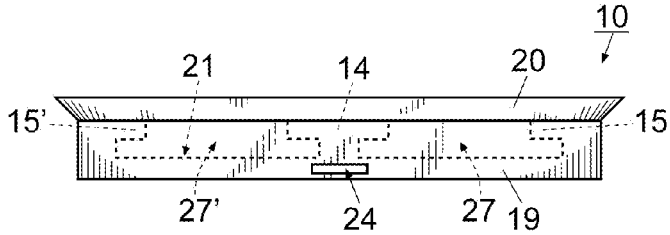
FIG. 7 provides a right end elevational view of the dining tray.
Figure 8:
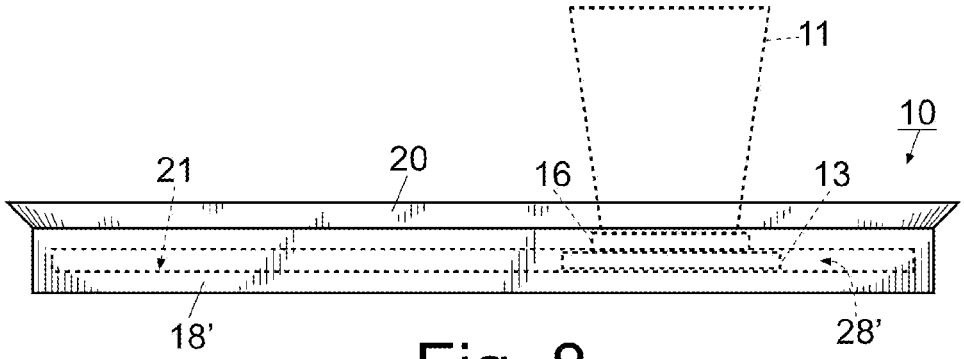
FIG. 8 illustrates a front elevational view of the dining tray with a beverage container shown in dotted line fashion.
Figure 9:
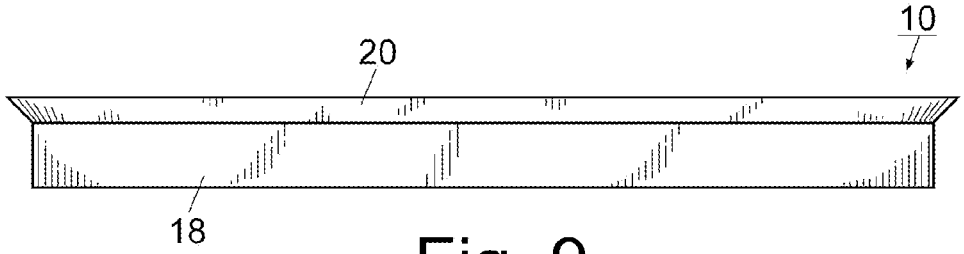
FIG. 9 depicts a rear elevational view of the dining tray.

For a better understanding of the invention and its operation, turning now to the drawings, FIG. 1 demonstrates preferred dining tray 10 with glass 11 and bowl 12 exploded therefrom. Dining tray 10 is preferably molded from a durable plastic although wood or other suitable materials may also be used. Dining tray 10 includes bottom 19 having planar upper surface 21, opposing sidewalls 18, 18' (FIG. 5), opposing L-shaped side members 15, 15', central T-shaped member 14, end walls 22, 22' (FIG. 5) and upper surrounding lip 20. As seen in FIGS. 6 and 7 opposing L-shaped side members 15, 15' and central T-shaped member 14 with bottom 19 form channels 27, 27' each having respective grooves 28, 28'. Glass 11 includes circular base 16 and lateral member 13 rigidly affixed thereto while bowl 12 includes circular base 17 and lateral member 13 rigidly affixed thereto. Lateral member 13 as also seen in FIGS. 10-14 is formed having an S-shape with opposing rounded corners 53 and opposing square corners 54 with planar upper and lower surfaces as seen in FIGS. 12 and 13.

Figure 2:
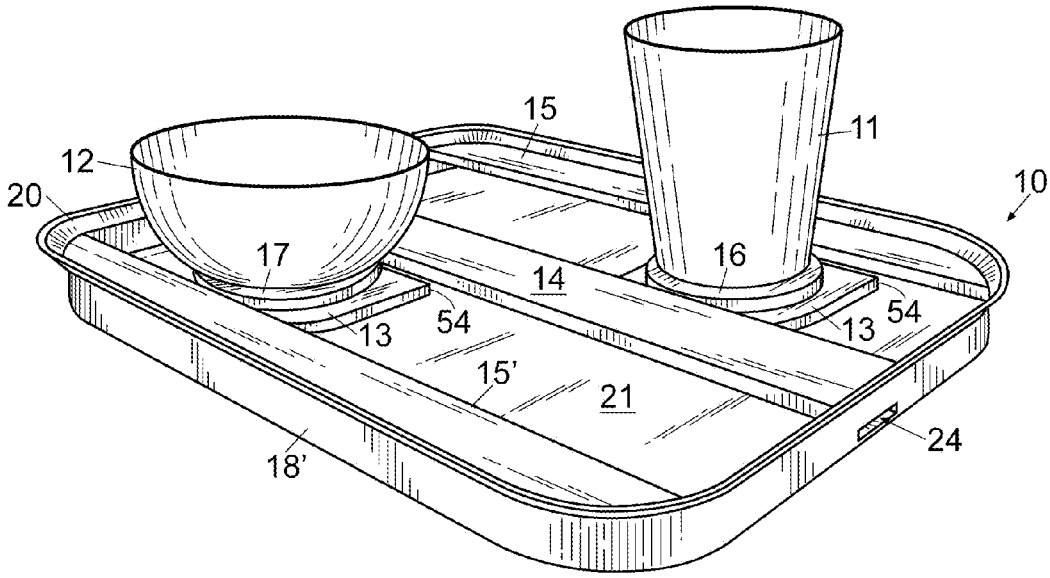
FIG. 2 pictures a perspective view of the dining tray with the food container and the beverage container positioned in an unlocked manner within the tray.
Figure 3:
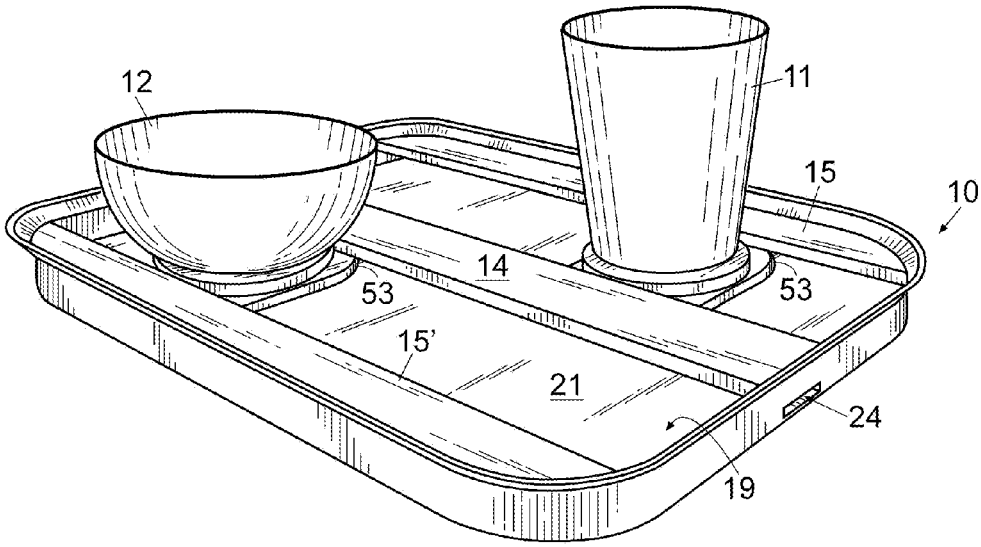
FIG. 3 depicts a perspective view of the dining tray with the food container and the beverage container positioned in a locked manner within the tray.
Figure 4:
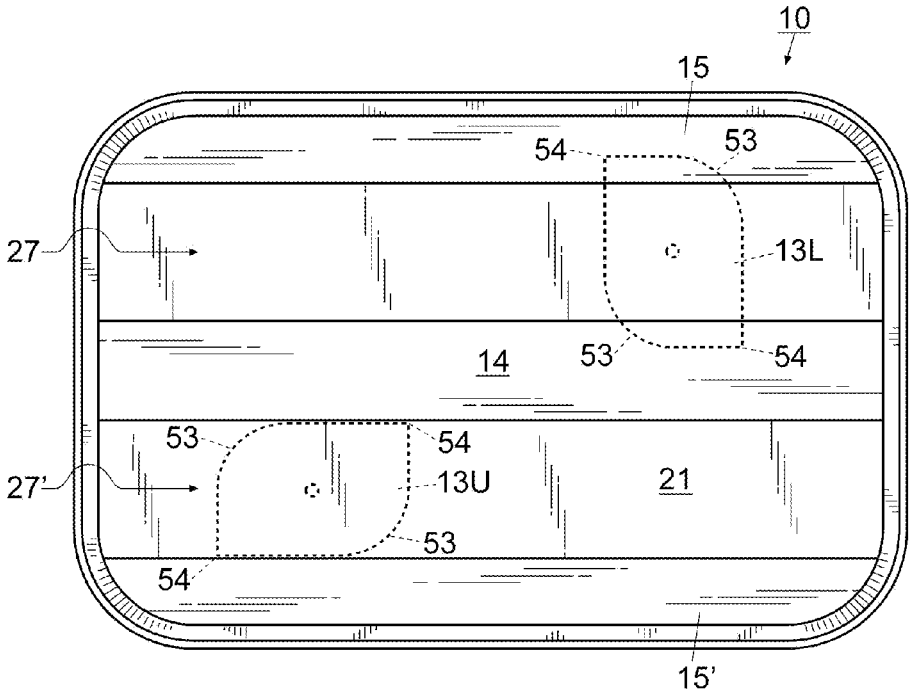
FIG. 4 demonstrates a top view of the dining tray with a pair of lateral members shown in dotted line fashion in an unlocked position and a locked position.

As shown in FIG. 2 glass 11 and bowl 12 are positioned in tray 10 in an unlocked fashion with lateral members 13 positioned in channels 27, 27'. In FIG. 3, glass 11 and bowl 12 have been rotated in a clockwise direction to a locked position within channels 27, 27'. As shown in FIG. 4 dotted line lateral member 13L is in a locked position and dotted line lateral member 13U is in an unlocked position. When lateral member 13 is rotated clockwise from position 13U rounded corners 53 slide under the edges of central T-shaped member 14 and L-shaped side members 15, 15' passing through grooves 28, 28' (FIG. 6) of channels 27, 27' whereby square corners 54 abut the inner side wall and will terminate and prevent further movement thus locking lateral member 13 within channel 27 or 27' as demonstrated by position 13L. This rotation locks lateral members 13 beneath the edges of central T-shaped member 14 (FIGS. 6 and 7) and L-shaped side members 15, 15' as seen in FIG. 3 to prevent removal or tilting. When lateral members 13 are positioned within channels 27, 27' bases 16 and 17 are rotatably positioned between the sides of L-shaped side members 15, 15' and central T-shaped member 14 to assist in stabilizing and maintaining food containers 11, 12 within channels 27, 27' whereby the tops of bases 16, 17 are horizontally planar with the tops of L-shaped side members 15, 15' and central T-shaped member 14.

While only two food containers (glass 11 and bowl 12) are shown herein various other containers such as coffee cups, plates, various size bowls and the like (not shown) can be provided with and used with a lateral member such as S-shaped lateral member 13 and a base such as base 16 or 17 affixed thereto. Lateral member 13 while preferably an S-shape could also be in rectangular or other shapes as desired. Side walls 18, 18' and end walls 22, 22' surround tray bottom 19 and support outwardly turned upper lip 20 which acts as a hand grip to assist a user in carrying and placement of tray 10. As would be understood, the inner surface 21 of bottom 19 (see FIGS. 6, 7, 8 and 9) is finished to a smooth texture to allow lateral member 13 to easily slide within channels 27, 27' and rotate thereon. Lateral member 13 may be affixed to food containers such as containers 11 and 12 such as by adhesives, nails, staples, screws or other fasteners, in addition, containers 11 and 12 may be molded and integrally formed with lateral members 13 as desired. Further while only two containers are shown in use with tray 10 many more could be used simultaneously depending on the number of food courses or beverages. For example, two glass containers one for milk and one for orange juice and a plate container for eggs and bacon while a bowl container may be used for grits and an additional bowl container for fresh fruit.

The method of use includes selecting the desired food/beverage containers for use with tray 10 and positioning lateral member 13 of each as seen in FIG. 4 by lateral member 13U. If needed the container could be slid for centering within channel 27' or positioned near the end for placement of an additional container therebeside within channel 27'. Once positioned, the container is rotated clockwise to the position as demonstrated by lateral member 13L to lock the container in place and prevent any further movement. Once all containers are locked in place, tray 10 can then be grasped by end walls 22, 22' and lip 20 and easily carried without fear of dropping any of the containers for placement on a table such as table 30 as seen in FIG. 15. When finished, tray 10 can then be removed and carried to the kitchen or the like whereby the containers are rotated counterclockwise to an unlocked position as seen in FIG. 4 by 13U and removed therefrom for cleaning purposes. Should any of the containers not be empty and could be saved for later lids (not shown) are provided for closing and storing the containers as desired.

As seen in FIG. 15, tray 10 is positioned on conventional table 30 with clamp 35 affixed thereto. Clamp 35 has an L-shaped insert member 36 which penetrates tray opening 24 as shown in FIGS. 1 and 2. While preferred tray opening 24 is shown in end wall 22, in alternate embodiments (not shown) opening 24 may be placed in side walls 18, 18' or otherwise as convenient. Tray clamp 35 includes L-shaped insert 36 which is pivotally joined to handle 37 having flat distal end 40. L-shaped insert 36 is sized to grip and exert pressure against tray 10 and cam head 38 of handle 37. Thus when handle 37 is rotated through cylindrical axle 39 during closing, L-shaped insert 36 applies pressure along the edge of table 30 to maintain tray 10 in a secure position thereon. Distal end 40 is flat to engage bottom surface 31 of table 30. Clamp 35 can be used for securing tray 10 during for example plane, train, ship, automobile or other forms of transportation.

The illustrations and examples provided herein are for explanatory purposes and are not intended to limit the scope of the appended claims.

We claim:

1. A tray comprising: a base, at least one L-shaped member, said L-shaped member attached to said base, said L-shaped member extending the length of said base, a container, a lateral member, said lateral member attached to said container, said lateral member for selectively engaging said L-shaped member, said lateral member defining an S-shape.

2. The tray of claim 1 wherein said base is planar.

3. The tray of claim 1 further comprising a T-shaped member, said T-shaped member attached to said base and opposing said L-shaped member.

4. The tray of claim 1 formed from plastic.

5. The tray of claim 1 formed from wood.

6. The tray of claim 1 further comprising a sidewall, said sidewall attached to said base.

7. The tray of claim 6 further comprising a lip, said lip attached to said sidewall.

8. The tray of claim 1 further comprising an end wall, said end wall attached to said base.

9. The tray of claim 1 wherein said tray defines a clamp opening.

10. A tray comprising: a planar base, a pair of opposing L-shaped side members, said pair of opposing L-shaped side members attached to said base, a central T-shaped member, said central T-shaped member attached to said base between said pair of opposing L-shaped side members to form a pair of channels therebetween, a container, a lateral member, said lateral member attached to said container, said container for selective rotation to engage said lateral member with one of said L-shaped side members and said T-shaped member.

11. The tray of claim 10 wherein said lateral member is S-shaped.

12. The tray of claim 3 wherein said T-shaped member extends the length of said tray.

* * * * *